United States Patent [19]

Schindler

[11] Patent Number: 4,691,824

[45] Date of Patent: Sep. 8, 1987

[54] WRAP-AROUND PACKAGING

[76] Inventor: Edgar C. Schindler, 11723 136th Ave. E., Puyallup, Wash. 98374

[21] Appl. No.: 924,990

[22] Filed: Oct. 30, 1986

[51] Int. Cl.[4] ..... B65D 25/28; B65D 8/18; B65D 85/00

[52] U.S. Cl. ..... 206/315.9; 206/509; 150/52 A; 220/4 F; 220/7; 220/94 A

[58] Field of Search ..... 206/315.9, 509; 150/52 A; 220/4 F, 94 A, 7

[56] References Cited

U.S. PATENT DOCUMENTS

| | | | |
|---|---|---|---|
| 1,861,948 | 6/1932 | Bankdoll | 206/315.9 |
| 3,258,091 | 6/1966 | Stevens | 150/52 A |
| 3,815,735 | 6/1974 | Cucuo | 206/315.9 X |
| 4,188,990 | 2/1980 | Ross | 150/52 A |
| 4,452,355 | 6/1984 | Benham | 206/315.9 X |
| 4,494,650 | 1/1985 | Cullen | 206/315.9 X |

OTHER PUBLICATIONS

Photographs of a ball container used by The Franklin Company.

*Primary Examiner*—William Price
*Attorney, Agent, or Firm*—Bruce A. Kaser

[57] ABSTRACT

A packaging apparatus is provided that snugly wraps around a product. The apparatus includes a plurality of cupping members each having an inwardly directed surface with portions shaped and curved to form-fit against the outer surface of the product. The cupping members are connected together in series and cooperatively encircle the product, with the first member being connected to the last by snaps.

11 Claims, 11 Drawing Figures

WRAP-AROUND PACKAGING

DESCRIPTION

1. Technical Field

This invention relates to product packaging, and in particular, to packaging which serves as containers for individually sold items.

2. Background Art

In general, one of the most familiar forms of wholesale and retail packaging is cardboard box containers. Many different items are packaged in boxes since boxes are well suited for shipping and for displaying items on a store's shelf or floor. The expenses associated with producing boxes can be significant, however, to the point where the cost of making a box can represent a sizable portion of the overall cost of manufacturing or producing the item contained in the box.

There are many factors which make the use of cardboard boxes expensive as packaging. First, cardboard itself is a relatively expensive material. Second, there is a significant cost associated with printing designs, logos and other matter on the outside of a box for identification and display purposes. Third, high labor costs are typically involved in folding cardboard into box form and placing individual items in the box. In addition, and particularly in the sporting goods business, there is a disadvantage in using cardboard boxes for selling balls because they make the dishonest switching of balls between boxes easy. By way of example, in high volume retail outlets, where large numbers of goods are sold, a common ploy is to remove a less expensive ball from its box and replace it with a more expensive one. When the ball and box are then taken to a checkout stand, the purchaser is usually charged for the less expensive ball unless the checkout person happens to open the box and inspect its contents. This usually does not happen, especially if the checkout person is extremely busy.

Accordingly, it is an object of the present invention to overcome the above-discussed disadvantages. As will become apparent, not only does the invention accomplish this but it also provides certain new features and advantages heretofore not known in the art.

DISCLOSURE OF THE INVENTION

To carry out the above object, a new and useful packaging apparatus has been developed. It should be understood at the outset that the apparatus disclosed hereinafter may be adaptable for use in packaging any of a wide variety of different products or items. However, for the purpose of example only, the present disclosure is directed to packaging sports balls such as spherically shaped basketballs, soccer balls, etc. or elipsoidally shaped footballs.

An apparatus in accordance with the present invention includes a plurality of four cupping members, each having an inwardly directed recessed area that is shaped and curved to form-fit adjacent a portion of a ball's outer surface. The cupping members are connected together in juxtapositional series in a row, and can swing and pivot relative to each other so that they cooperatively wrap around and circumscribe the ball. Included in the invention is means for connecting the first cupping member in the series to the last or fourth cupping member, thus holding the ball in the space defined centrally between all four cupping members.

Certain portions of the ball not in contact with the cupping members are exposed to the touch.

The four cupping members are wrapped around the ball and are spaced equidistantly from each other around the ball's circumference. This means the first and third members of the series are substantially parallel to each other on opposite sides of the ball, and the second and fourth members are also substantially parallel, but are opposingly positioned next to the lower and top sides of the ball, respectively.

The second and fourth members include pedestal portions that respectively provide a base for placing the packaging apparatus on a shelf or floor, and a top surface for stacking one packaging apparatus on top of another. More specifically, the second cupping member has an outwardly facing surface area that includes a substantially flat and horizontal surface. This flat surface provides a base pedestal below the ball and permits the apparatus and ball to stably sit on a shelf or floor. The fourth cupping member similarly has an outwardly facing area that includes a substantially flat and horizontal surface, but this surface is positioned directly over the top of the ball although parallel to the lower surface.

A recessed annular groove is located in the base pedestal, and an outwardly projecting annular tongue is located in the top pedestal. The tongue is sized for tongue-in-groove fitment with the annular groove, and this permits stable linking of stacked apparatuses where the base pedestal of one apparatus fits to the top pedestal of the other.

The first of the above-described cupping members is connected to the last by a splitable handle that is made of a pair of half-handle members. One half-handle is connected to the first cupping member and the other is connected to the last. Each is made of a flexible material and both have a strap portion and a handle portion. The strap portion of one has a snap knob that is sized for snapping engagement with a socket opening in the strap portion of the other. At least one snap knob of a similar nature is located in one handle portion and is similarly sized for engagement with a socket opening in the other handle portion. The snap knobs are used to releasably mate the half-handles together, for the purpose of not only holding the ball between the cupping members, but to form a carrying handle for the packaging apparatus. The handle's easy splitability makes it very easy to quickly wrap the apparatus around the ball and to remove it when desired.

The four above-described cupping members, including the above-described half-handle members, are made or formed together as a single piece of molded plastic. Each cupping member is connected to an adjacent cupping member by a portion or section of relatively flexible plastic, which permits the previously mentioned swinging and pivotal movement of the cupping members.

The disclosure of the invention as summarized above, including the advantages associated therewith, is further described in the following, and in the drawings which are in accompaniment herewith.

BRIEF DESCRIPTION OF THE DRAWINGS

In the drawings, like reference numerals and letters refer to like parts throughout the various views, and wherein.

BEST MODE FOR CARRYING OUT THE INVENTION

Figure 1:
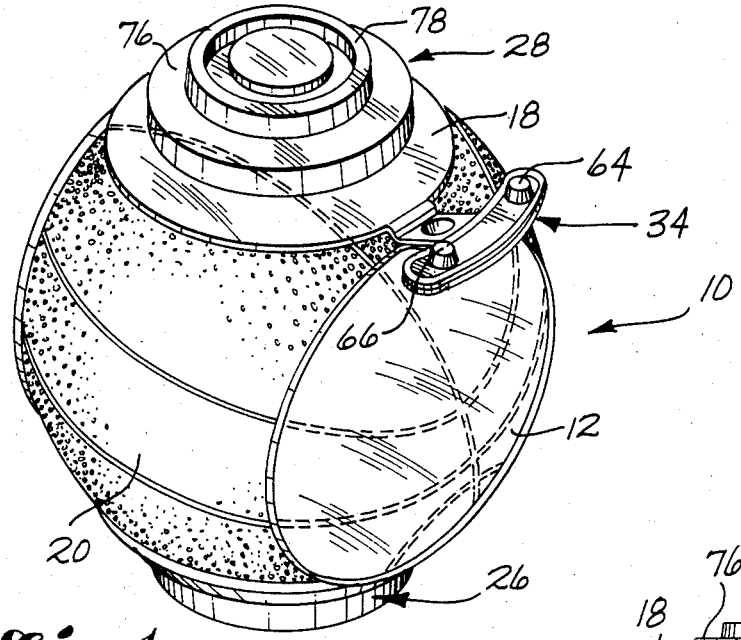
FIG. 1 is a pictorial view of a packaging apparatus constructed in accordance with a preferred embodiment of the invention, and shows the apparatus holding a basketball.

Referring now to the drawings, and first to FIG. 1, therein is shown at 10 a packaging apparatus constructed in accordance with a preferred embodiment of the invention. The apparatus 10 includes four circular bowl-shaped cupping members or cups 12, 14, 16, 18 which are wrapped around and circumscribe a ball 20. It should be understood that the ball 20 appears to be a basketball, but could be any type of spherical ball.

Figures 7, 8, 9, 10, 11:
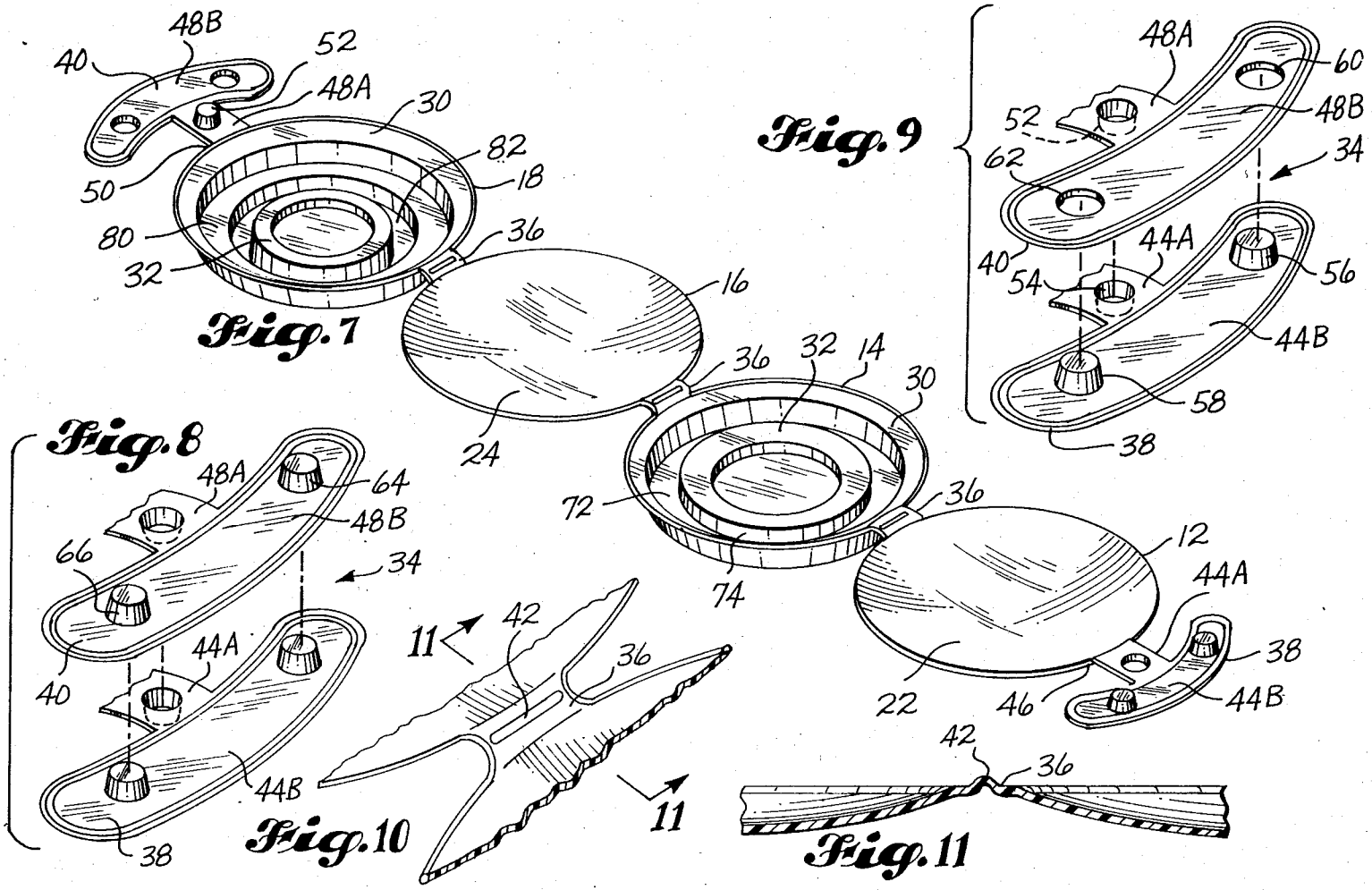
FIG. 7 is a pictorial view showing the one-piece construction of the packaging apparatus shown in FIG. 1, with the apparatus being disconnected and unfolded or unwrapped from the ball.
FIG. 8 is an enlarged fragmentary pictorial view of the splitable handle which is used to connect and wrap the apparatus shown in FIGS. 1–7 around a ball.
FIG. 9 is a view like FIG. 8 but shows an alternative way of snapping the splitable handle together.
FIG. 10 is an enlarged fragmentary pictorial view of each portion or section of flexible plastic material which connects together the plurality of cupping members shown in FIG. 7.
FIG. 11 is a side cross-sectional view of the connecting section shown in FIG. 10, and is taken along line 11—11 in FIG. 10.

As is best seen in FIG. 7, each cup 12, 14, 16, 18 has an inwardly directed surface area that is shaped and curved to fit against the curvature of the ball's surface. For example, the first and third cups 12, 16, when wrapped around the ball 20, are substantially parallel to each other and cup snuggly against the ball on opposite sides. Each has an inner surface 22, 24, respectively, with spherical contours that match the ball's shape. The second and fourth cups 14, 18 not only cup the ball 20, but also provide a base and top pedestal for the apparatus 10, as indicated at 26, 28, respectively. Like the first and third cups 12, 16, the second and fourth cups are also parallel, but the second 14 is positioned below the ball 20 and the fourth 18 is positioned above. The second and fourth cups 14, 18 also have inwardly directed surface areas in the form of spherical sectors 30, 32, which are, of course, shaped and curved to fit against the ball's surface. These areas 30, 32 are not continuous like the inner surfaces 22, 24 of the first and third cups 12, 16, but are more in the form of generally annularly shaped spherical contours. The purpose of this is to accommodate the molded construction of the base and top pedestals 26, 28 in the cups 14, 18.

The four cups 12, 14, 16, 18 are connected together juxtapositionally in series in a line as shown in FIG. 7. When wrapped around the ball 20 they are held in place by a splitable handle indicated generally at 34 in FIGS. 8 and 9. Each cup is connected to an adjacent one by a section or portion of flexible plastic 36, which permits the various cups to swing and pivot relative to each other. The splitable handle 34 has two half-handle portions 38, 40 which are connectable to each other in a manner to be described later.

The cups 12, 14, 16, 18, including their interconnecting flexible sections 36 and the half-handle portions 38, 40, are preferably molded from a single piece of plastic material. Each connecting section 36 has an elongated crimped portion 42 which extends transversely between adjacent cups and permits the cups to easily swing and pivot into snug position against the ball 20 as shown in FIG. 2.

Each half-handle portion 38, 40 of the splitable handle includes a strap-like or strap portion and a handle-like or handle portion. The strap portion 44*a* of one is connected to an outer edge 46 of the first cup 12. Similarly, the strap portion 48*a* of the other is connected to the outer edge 50 of the fourth cup 18. Referring now to FIG. 9, one strap portion 48*a* includes a projecting snap knob 52, which is sized for snapping engagement with a socket opening 54 in the other strap portion 44*a*. Similarly, one handle portion 44*b* has a pair of snap knobs 56, 58 sized for snapping engagement with socket openings 60, 62 in the other handle portion 48*a*. The various socket openings 52, 60, 62 may be open holes as shown in FIG. 9, or they may be capped recesses 64, 66 as shown in FIG. 8. The various knobs snap into the various socket openings to fasten one half-handle portion 38 to the other 40. This holds the cups 12, 14, 16, 18 around the ball 20. The handle 34 is easily split to unwrap the cups from the ball.

Figure 2:
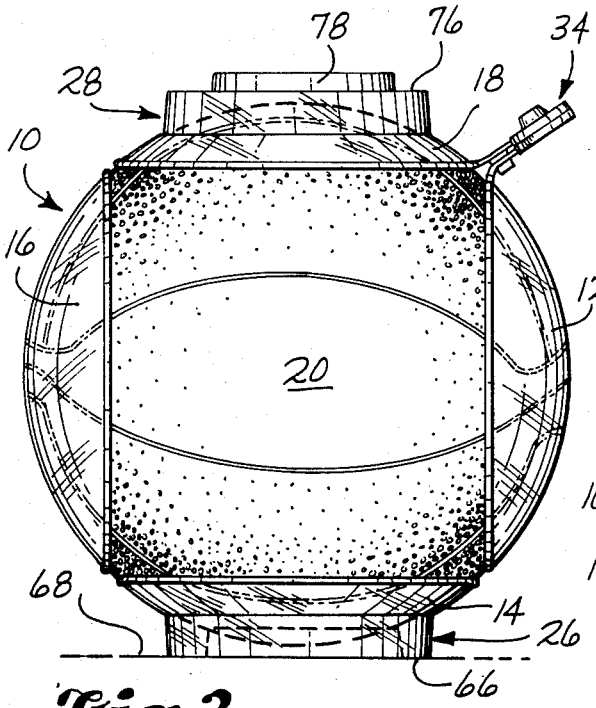
FIG. 2 is a side elevational view of the packaging apparatus shown in FIG. 2.

The base pedestal 26 has a substantially flat and horizontal surface 66 which may rest on a shelf or other surface 68 (see FIG. 2). Preferably, this surface 66 is annular in configuration and has an annular recessed groove 70. Since the apparatus 10 is preferably molded from one piece of plastic, the inner sides of this surface 66 and groove 70 can be seen in FIG. 7 at 72 and 74, respectively.

The top pedestal 28 also has a flat and horizontal surface 76 positioned directly over the ball 20. Similar to the bottom surface 66, this top surface 76 is preferably annular in shape. Located in the top surface 76 is an outwardly projecting annular tongue 78. The tongue 78 is sized for tongue-in-groove fitment with the annular groove 70 in the base pedestal 26. Referring again to FIG. 7, the inward side of the top surface 76 is indicated at 80 and the annular tongue is indicated at 82.

Figure 3:
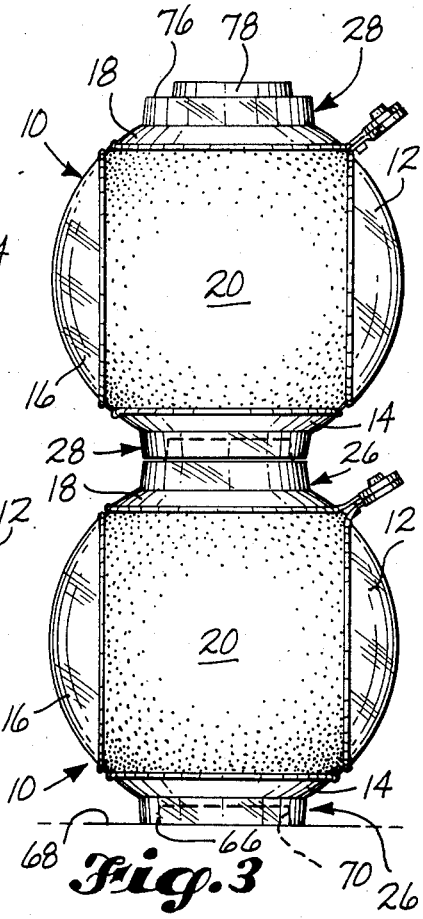
FIG. 3 is a side elevational view of two balls held in two packaging apparatuses each like that shown in FIGS. 1 and 2, with one apparatus being stacked on top of the other.

The flat surfaces 66, 76, and the annular tongue 78 and groove 70 in the base and top pedestals 26, 28, respectively, permit the stable stacking of one apparatus 10 on top of another. This is best shown in FIG. 3.

Figure 4:
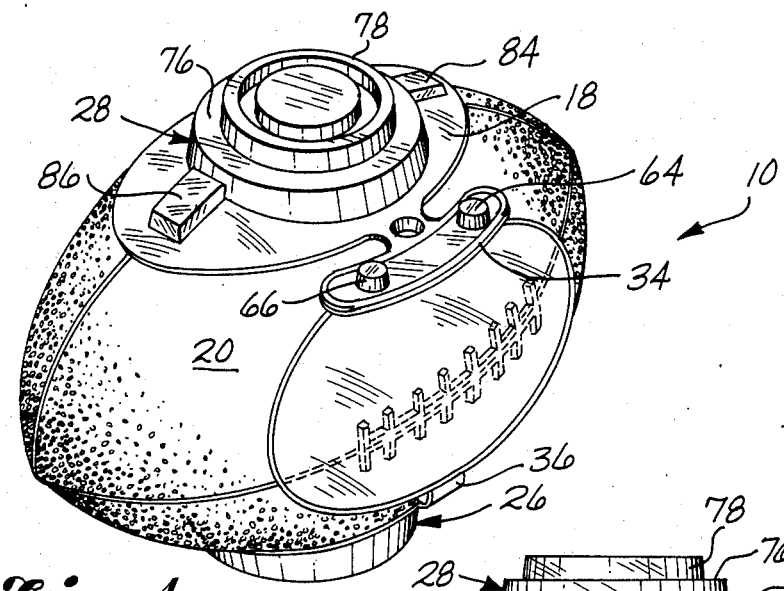
FIG. 4 is a view like FIG. 1, but shows an alternative embodiment of the apparatus adapted for packaging a differently shaped ball.
Figure 5:
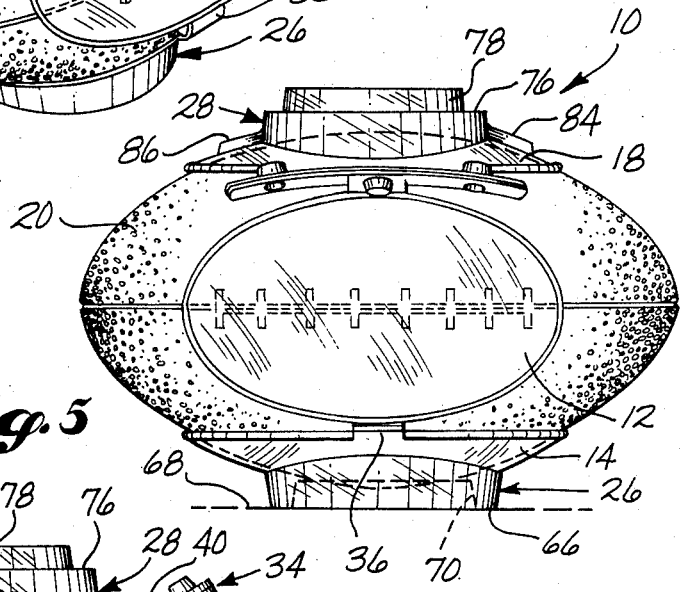
FIG. 5 is a side elevational view of the ball and apparatus shown in FIG. 4.
Figure 6:
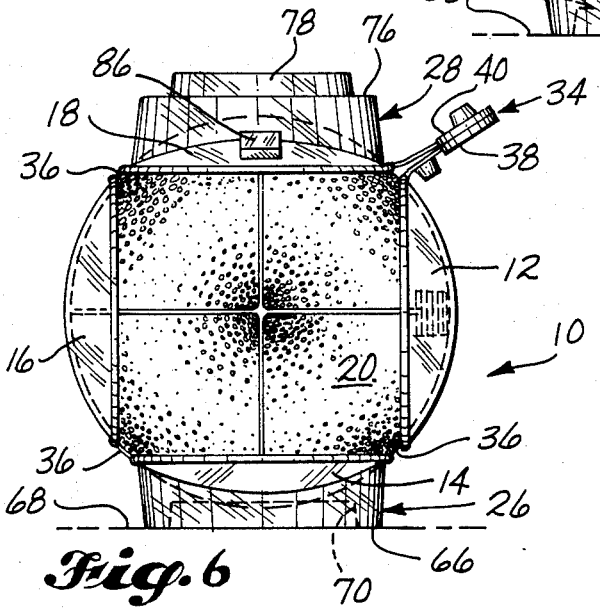
FIG. 6 is an end elevational view of the ball shown in FIGS. 4 and 5.

FIGS. 4–6 show an alternative embodiment of the invention adapted for packaging a football. As can be seen, similar to the embodiment shown in FIGS. 1–3 the four cups 12, 14, 16, 18 have inwardly directed surfaces shaped to fit against the surface of a football. The outer surface of the fourth cup 18 may additionally include buttresses 84, 86 which strengthen this particular cup against buckling.

The advantages of the apparatus 10 are manyfold. Use of plastic material to make the apparatus 10 is much less expensive than the use of cardboard to make boxes. For example, the basic cost of plastic is less than the basic cost of cardboard. In addition, preferably the plastic material is clear and any trademarks and designs printed on the ball can be clearly seen through the plastic thus eliminating costs associated with printing artwork on the outside of a box. In this regard, the previously-mentioned ball-switching problem is eliminated. A checkout person can clearly see the type and quality of a ball as it passes through a checkout stand. From the standpoint of a consumer, not only can he see the ball packaged in the apparatus 10, but since the four cups 12, 14, 16, 18 do not enclose the ball entirely, the consumer also has the opportunity to touch and feel the ball.

The apparatus 10 further reduces labor costs, not only in the amount of labor expended to produce the apparatus 10, but in the amount of labor required to place or package a ball or other item in the apparatus. For example, a person responsible for packaging a ball merely places the ball in one of the four cups 12, 14, 16, 18 and quickly snaps the handle 34 together. The handle 34 can be used by the consumer to carry both the ball and the apparatus 10 after it is purchased. Further, the cups are easily cut apart to permit the base pedestal 26 of the second cup 14 to be used as a trophy pedestal for displaying or storing the ball, if desired.

Although the apparatus 10 as described above was directed to packaging inflatable sports balls, the invention has universal applicability to a wide variety of products. The scope of patent protection granted in this case should not be limited to the packaging of balls. It is conceivable, for example, that the invention could be used for packaging a myriad of products, especially those having symmetrical outer contours. The scope of patent protection, therefore, is to be limited only by the subjoined claims which follow, in accordance with the well-established doctrines of patent claim interpretation.

What is claimed is:

1. An apparatus for packaging an item, comprising:

a plurality of at least four cupping members each having an inwardly directed recess shaped to substantially form-fit against a portion of the item's outer surface, said members being connected together in juxtapositional series in a manner so that they cooperatively circumscribe said item; and snap fastening means for releasably connecting a first member of said series to a last member of said series, to hold said item between said members.

2. The packaging apparatus of claim 1, wherein each cupping member is connected to an adjacent cupping member by a flexible material, said material having a crimped portion extending transversely between said adjacent members.

3. The packaging apparatus of claim 1, wherein said plurality of cupping members includes four cupping members connected together in juxtapositional series, wherein said last member is said fourth member, and wherein the second cupping member is a base pedestal member having an outwardly facing surface area that includes a substantially flat surface portion, said flat surface portion and said inwardly directed recessed area of said pedestal member providing a supporting base for said item and said apparatus.

4. The packaging apparatus of claim 3, wherein said base pedestal member's flat surface portion has an annular groove, and wherein said fourth cupping member comprises a top pedestal member having an outwardly facing surface area that includes a substantially flat surface portion, said top pedestal member's outwardly facing surface area further including an annular tongue projecting outwardly from said top pedestal member's flat surface portion, said annular tongue being sized for tongue-in-groove fitment with said annular groove of said base pedestal member, to permit vertical stacking of said apparatus with another apparatus.

5. The packaging apparatus of claim 4, wherein said snap fastening means includes:

a pair of half-handle members, each being made of a flexible material and each having a strap-like portion and a handle-like portion, wherein one of said strap-like portions is connected to an edge of said first cupping member, and the other of said strap-like portions is connected to an edge of said fourth cupping member, one of said strap-like portions having a snap knob sized for snapping reception by a socket opening in said other strap-like portion, and further, one of said handle-like portions having at least one snap knob sized for snapping reception by a socket opening in said other handle-like portion, so that said pair of half-handle members may be releasably mated to each other to connect said first cupping member to said fourth cupping member, to hold said item between all of said cupping members, and to form a handle for carrying said packaging apparatus when said item is so held.

6. The packaging apparatus of claim 5, wherein said four cupping members, and said flexible material connecting said cupping members, and said half-handle members, are all molded from a single piece of plastic material.

7. The packaging apparatus of claim 1, wherein said item is a sports ball, and with said plurality of cupping members comprising four cupping members connected together in juxtapositional series, wherein said last member is said fourth member, and wherein said members are spaced equidistantly around said ball in a manner so that the first and third members of said series are substantially parallel to each other, with said recesses of said first and third members opposing each other on opposite sides of said ball, and wherein said members are spaced in a manner so that the second and fourth members of said series are substantially parallel to each other, with said recesses of said second and fourth members opposing each other.

8. The packaging apparatus of claim 7, wherein each cupping member is connected to an adjacent cupping member by a flexible material, said material having a crimped portion extending transversely between said adjacent members.

9. An apparatus for packaging a sports ball or the like, comprising:

a plurality of at least four cupping members each having an inwardly directed recess curved to fit against a portion of said ball's outer surface, said members being connected together in juxtapositional series in a manner so that they cooperatively circumscribe said ball wherein each cupping member is connected to an adjacent cupping member by a flexible material, said material having a crimped portion extending transversely between said adjacent members; and snap fastening means for releasably connecting a first member of said series to a last member of said series, to hold said ball between said members.

10. The packaging apparatus of claim 9, wherein said plurality of cupping members includes four cupping members connected together in juxtapositional series, and wherein said last member is the fourth member in said series, and further, said snap fastening means includes:

a pair of half-handle members, each being made of a flexible material and each having a strap-like portion and a handle-like portion, wherein one of said strap-like portions is connected to an edge of said first cupping member, and the other of said strap-like portions is connected to an edge of said fourth cupping member, one of said strap-like portions having a snap knob sized for snapping reception by a socket opening in said other strap-like portion, and further, one of said handle-like portions having at least one snap knob sized for snapping reception by a socket opening in said other handle-like portion, so that said pair of half-handle members may be releasably mated to each other to connect said first cupping member to said fourth cupping member, to hold said ball between all of said cupping members, and to form a handle for carrying said packaging apparatus when said ball is so held.

11. The packaging apparatus of claim 10, wherein said four cupping members, and said flexible material connecting said cupping members, and said pair of half-handle members, are all molded from a single piece of plastic material.

* * * * *